US009714741B2

(12) United States Patent
Sandidge

(10) Patent No.: US 9,714,741 B2
(45) Date of Patent: Jul. 25, 2017

(54) METHOD AND SYSTEM TO VOLUMETRICALLY CONTROL ADDITIVE PUMP

(71) Applicant: PCS Ferguson, Inc., Frederick, CO (US)

(72) Inventor: Dustin Levi Sandidge, Grand Junction, CO (US)

(73) Assignee: PCS Ferguson, Inc., Frederick, CO (US)

( * ) Notice: Subject to any disclaimer, the term of this patent is extended or adjusted under 35 U.S.C. 154(b) by 444 days.

(21) Appl. No.: 14/185,180

(22) Filed: Feb. 20, 2014

(65) Prior Publication Data

US 2015/0233530 A1 Aug. 20, 2015

(51) Int. Cl.

| | |
|---|---|
| ***E21B 43/16*** | (2006.01) |
| ***F17D 3/01*** | (2006.01) |
| ***E21B 47/10*** | (2012.01) |

(52) U.S. Cl.

CPC ..... *F17D 3/01* (2013.01); *E21B 43/16* (2013.01); *E21B 47/10* (2013.01); *Y10T 137/0324* (2015.04); *Y10T 137/85986* (2015.04)

(58) Field of Classification Search

USPC ..... 166/90.1; 137/2, 565.11

See application file for complete search history.

(56) References Cited

U.S. PATENT DOCUMENTS

| | | | |
|---|---|---|---|
| 3,211,225 | A | 10/1965 | Thiessen et al. |
| 3,710,867 | A | 1/1973 | Bansbach |
| 4,064,936 | A | 12/1977 | McClure |
| 4,160,734 | A | 7/1979 | Taylor et al. |
| 4,284,143 | A | 8/1981 | Scherrer et al. |
| 4,354,553 | A | 10/1982 | Hensley |
| 4,375,833 | A | 3/1983 | Meadows |
| 4,436,148 | A | 3/1984 | Maxwell |
| 4,566,536 | A | 1/1986 | Holmes |
| 4,580,952 | A | 4/1986 | Eberle |

(Continued)

FOREIGN PATENT DOCUMENTS

| | | | |
|---|---|---|---|
| JP | S61-261514 | A | 11/1986 |
| WO | 9850680 | A2 | 11/1998 |
| WO | 9857030 | A1 | 12/1998 |

*Primary Examiner* — Taras P Bemko

(74) *Attorney, Agent, or Firm* — Russell T. Manning; Marsh Fischmann & Breyfogle LLP

(57) ABSTRACT

A chemical/additive injection controller, system and method (i.e., utilities) are provided that control when an injection pump turns on and off in order to inject a predetermined volume of additives into a hydrocarbon production conduit over a predetermined number of cycles per day. The controller determines when to activate and deactivate (i.e., turn on and turn off) an injection pump to provide a desired total additive injection volume over an injection period (e.g. 24 hours). More specifically, the utilities incorporate a flow meter that monitors the actual amount of additive that is injected during a pump cycle. Once an injected volume meets or exceeds a target injection volume the pump is deactivated. The flow meter continues to monitor the injection volume including amounts injected after power to the pump is deactivated to provide an accurate measure of the total injection. Subsequent injections are varied based on the actual measured volume of one or more previous injections.

16 Claims, 7 Drawing Sheets

(56) References Cited

U.S. PATENT DOCUMENTS

| | | | |
|---|---|---|---|
| 4,582,131 | A | 4/1986 | Plummer et al. |
| 4,635,723 | A | 1/1987 | Spivey |
| 4,665,981 | A | 5/1987 | Hayatdavoudi |
| 4,721,158 | A | 1/1988 | Merritt, Jr. et al. |
| 4,747,451 | A | 5/1988 | Adams, Jr. et al. |
| 4,830,112 | A | 5/1989 | Erickson |
| 4,832,121 | A | 5/1989 | Anderson |
| 4,843,247 | A | 6/1989 | Yamazoe et al. |
| 4,901,563 | A | 2/1990 | Pearson |
| 4,907,857 | A | 3/1990 | Giuliani et al. |
| 4,974,929 | A | 12/1990 | Curry |
| 5,059,790 | A | 10/1991 | Klainer et al. |
| 5,098,659 | A | 3/1992 | Yim et al. |
| 5,115,811 | A | 5/1992 | Hartlaub et al. |
| 5,147,561 | A | 9/1992 | Burge et al. |
| 5,172,717 | A | 12/1992 | Boyle et al. |
| 5,209,300 | A | 5/1993 | Ayres |
| 5,209,301 | A | 5/1993 | Ayres |
| 5,307,146 | A | 4/1994 | Porter et al. |
| 5,353,237 | A | 10/1994 | Bass et al. |
| 5,359,681 | A | 10/1994 | Jorgenson et al. |
| 5,413,175 | A | 5/1995 | Edmunds |
| 5,418,614 | A | 5/1995 | Brost et al. |
| 5,517,593 | A | 5/1996 | Nenniger et al. |
| 5,569,838 | A | 10/1996 | Broedel et al. |
| 5,570,437 | A | 10/1996 | Kluth et al. |
| 5,590,958 | A | 1/1997 | Dearing, Sr. et al. |
| 5,672,515 | A | 9/1997 | Furlong |
| 5,706,896 | A | 1/1998 | Tubel et al. |
| 5,714,121 | A | 2/1998 | Alderete et al. |
| 5,735,346 | A | 4/1998 | Brewer |
| 5,747,348 | A | 5/1998 | Jaduszliwer et al. |
| 5,829,520 | A | 11/1998 | Johnson |
| 5,872,876 | A | 2/1999 | Kluth et al. |
| 5,937,946 | A | 8/1999 | Streetman |
| 5,992,230 | A | 11/1999 | Scarpa et al. |
| 5,992,250 | A | 11/1999 | Kluth et al. |
| 6,006,828 | A | 12/1999 | Kluth et al. |
| 6,006,832 | A | 12/1999 | Tubel et al. |
| 6,022,748 | A | 2/2000 | Charych et al. |
| 6,026,847 | A | 2/2000 | Reinicke et al. |
| 6,125,938 | A | 10/2000 | Garcia-Soule et al. |
| 6,851,444 | B1 | 2/2005 | Kohl et al. |
| 7,277,778 | B2 | 10/2007 | Burns, Sr. et al. |
| 7,389,787 | B2 | 6/2008 | Means et al. |
| 7,841,394 | B2 | 11/2010 | McNeel et al. |
| 8,327,875 | B2 | 12/2012 | Grace et al. |
| 8,555,914 | B2 | 10/2013 | Smith, IV et al. |
| 2003/0056695 | A1* | 3/2003 | Macklin ..... B28C 5/404 106/644 |
| 2006/0047360 | A1* | 3/2006 | Burns, Sr. ..... G05D 7/0676 700/231 |
| 2008/0121391 | A1 | 5/2008 | Durham et al. |
| 2009/0276100 | A1 | 11/2009 | Malki et al. |
| 2011/0186302 | A1* | 8/2011 | Coyle ..... E21B 43/128 166/372 |
| 2012/0271527 | A1* | 10/2012 | Zebrowski ..... F02C 7/228 701/100 |

* cited by examiner

METHOD AND SYSTEM TO VOLUMETRICALLY CONTROL ADDITIVE PUMP

FIELD

The present disclosure relates to an apparatus, system and method (i.e., utilities) for controlling the injection of chemicals or additives into a hydrocarbon well bore, pipeline or other production and process system (e.g., hydrocarbon production conduit). More specifically, the presented utilities volumetrically control the operation of individual pump cycles of a pump that injects additives into a wellbore or pipeline to control the total volume of additives injected over multiple pump cycles.

BACKGROUND

The ability to produce oil and/or gas from a subterranean well may be improved by injecting chemicals/additives into the well. An injection pump can inject various additives for different applications, such as a foaming agent to increase gas production, a corrosion/scale inhibitor to protect tubing from damage/build-up, and/or methanol to prevent gas from freezing in a production line. Depending on the specification of the well and/or the application, the pump may have to inject a different amount of additive for each well or each type of additive. Also, depending on the application, the additive may need to be pumped into the well in one batch per day or in multiple batches per day. For example, if an additive is injected into a well in one batch per day this is referred to as one cycle per day. Likewise, if an additive is injected into a well in four batches at four times that are equally spaced over a day, this is referred to as four cycles per day. In some applications, it is desirable to inject small batches of additives at short intervals throughout a day for production purposes. In an application where additives are injected once per minute for an entire day, there are 1440 cycles per day. Cycles per day may also be referred to as pump cycles or injection cycles.

In theory, an injection pump runs at a constant speed so that a controller need only operate the pump for fixed temporal durations intermittently for the desired number of cycles to inject the desired amount of chemical into the well/pipeline. However, in practice, the pump injection rate varies with each well site due to the wellhead conditions such as: (a) the point where the additives are injected into the well, for example some additives are injected at the wellhead at ground level and some additives are injected down into the borehole of the well itself; (b) the wellhead pressure at the point of injection; (c) the size of injection lines between the chemical tank and the point of injection; (d) the type and number of fittings in injection lines between the additive tank and the point of injection; (e) the length of the injection lines between the additive tank and the point of injection; and (f) the viscosity of the additive, which may vary based on temperature. Further, in remote applications, pumps are often run by DC sources (e.g., solar cells or batteries) and variation in the voltage or current of the power source may affect the speed of the pump. Finally, pumps and associated components (e.g., check valves, etc.) wear over time resulting in changing operating parameters. Any of these factors may affect the pump injection rate of a pump.

To account for variations in pump injection rates, previous systems have required that operators run an injection rate test at the well to determine how fast the pump injects additives into a specific well. This information is utilized to determine what operating duration (e.g., pump on time) is required for the injection pump to inject a desired volume of additive into the well for each injection cycle. However, such an approach is only valid if the system remains static. This is, if there are changes in the well parameters (e.g., well head pressure) and/or the pump operation (e.g., variation in power supply), the operating duration required to inject a desired amount of additive changes.

Another approach is shown in the patent to Burns, Sr. et al. (U.S. Pat. No. 7,277,778) (Burns) which discloses a chemical injection pump system for wells with a controller taking commands from a local operator's control panel and from remote operator's control panel. The operator selects a specific injection pump type from the data files within the controller where the pump type selected in the controller is a very specific chemical injection pump type having a very specific pumping capacity and this specific injection pump type is used by the controller to compute the number of strokes required to dispense a desired volume of additive into the well. The controller in Burns is connected to a first sensor and a second sensor. The first sensor is for sensing a deactivated state of the pump. The second sensor is for sensing an activated state of the pump, to dispense a pre-determined quantity of chemical and to verify that the pump has actually operated. The controller assumes that all pumps of same type inject at the same rate without consideration of the wellhead conditions which vary significantly from well to well. Further the system typically requires expensive specialized pumps.

It is desirable to tightly control per cycle injection volumes for a number of reasons. In near continuous injection applications (e.g. 1440 cycles per day; once per minute) the repeated injection of small volumes of additives may significantly increase production of a well. Thus, it is often desirable to inject at least a minimum target volume of additives during each injection cycle; under injection can effect production. In contrast, over injection of additives often produces no production benefit and can be a significant operating expense. For instance, for a producer operating a thousand wells each requiring 6 L of additive per day, with an exemplary cost of $10/L, an over injection rate of 50% (9 L per day, per well) results in $360,000 in annual excess additive expenses.

Accordingly, it would be desirable to provide a chemical injection controller that controls pump operation based on actual volumes injected by the pump. Such a controller may inject a desired volume of additives irrespective of changes in well/pipeline pressures or conditions and/or variations in pump operation. Finally, it would be desirable for such a controller to minimize over injection while maintaining a desired per cycle injection volume.

SUMMARY

The presented inventions are directed to a chemical/additive injection controller, system and method (i.e., utilities) that control when an injection pump turns on and off in order to inject a predetermined volume of additives into a hydrocarbon well bore or other production and process system (e.g., hydrocarbon production conduit) over a predetermined number of cycles per day. The controller determines when to activate and deactivate (i.e., turn on and turn off) an injection pump to provide a desired total additive injection volume over an injection period (e.g., 24 hours). More specifically, the utilities incorporate a flow meter that monitors the amount of additive that is injected during operation of a pump (i.e., during a pump cycle). Once an injected volume meets or exceeds a target injection volume for a specific pump cycle, the pump is deactivated. Such an arrangement eliminates the need of a user to perform any rate test for a specific well. That is, rather than varying run time of a pump based on well specific parameters and other variables, the utilities operate an injection pump utilizing a volumetric control such that a pump operates until a target volume of additive is injected into a well or other production and process system.

The ability to control injection pump operation based on pumped/injected volume allows the utilities to be incorporated with any existing pump. That is, no specialized pump is required. However, the inventor has further recognized that simple volumetric control can lead to certain inefficiencies. For instance, many pumps continue to operate for a short duration after power to the pump is shut off. That is, many pumps coast to a stop after power is shut off. Accordingly, these pumps continue to pump additive as they coast to a stop (i.e., pump coast). Pump coast is especially evident in pumps that utilize a brushed motor, however, it also is present in pumps utilizing brushless motors, albeit to a lesser extent. The result of the additional volume of additive pumped during pump coast is of little consequence when additives are injected in a few cycles over a large time period (e.g., four cycles per day). However, in injection applications having hundreds or thousands of injection cycles (e.g., 1440 cycles per day; once per minute), the cumulative effect of the additional volume of additives pumped during shutdown can lead to significant over injection of such additives. As will be appreciated, this over injection of additives is wasteful and can lead to significant increased operating expenses.

To alleviate the over injection caused by continued pumping during pump shut down or coast, aspects of the presented utilities utilize what is referred to as "Predictive Pump Coast" (PPC) to reduce over injection. PPC measures the actual pumped volume during a pump cycle and compares the actual pumped volume to a fixed target volume for the pump cycles. The actual pumped volume is measure by the flow meter after all fluid flow, through an additive conduit monitored by the flow meter, ceases. This allows measuring the total pumped volume including the pump coast volume. If the actual pumped volume exceeds a target volume for the pump cycle, the target volume is adjusted for the subsequent cycle. By way of example only, if an initial target volume for a pump cycle is 0.1 L and an actual volume pumped during a pump cycle is 0.12 L, the subsequent pump cycle (e.g., second pump cycle) may utilize an adjusted target volume of 0.08 L. Accordingly, the actual volume pumped during the subsequent pump cycle may be again compared to the initial or fixed target volume in order to further adjust the next pump cycle. Continuing with the above-noted example, if the second pump cycle pumps an actual volume of 0.11 L, (i.e., 0.01 L in excess of the fixed target volume; 0.11 L-0.1 L) the adjusted target volume may be further reduced to, for example 0.07 L for the next (e.g., third) pump cycle. As will be appreciated, the ability to adjust the target volumes for pump cycles provides a means for accounting for pump coast during pump shut down. That is, operating a pump to pump the adjusted target volume may produce an actual pumped volume (including a pump coast volume) that will more closely match the desired target volume.

According to a first aspect, utilities are provided which are directed to an overall system for use and controllably injecting an additive into a hydrocarbon production conduit. The utilities include a pump fluidly connected to an additive source and a hydrocarbon production conduit. The pump is operative to inject additive from the additive source into the hydrocarbon production conduit. A flow meter is disposed in a fluid conduit connecting the additive source and the hydrocarbon production conduit. The flow meter is operative to provide output signals that are representative of a fluid volume pumped by the pump during a pump cycle (i.e., during an activation and deactivation cycle of the pump). More specifically, the flow meter is operative to provide at least a first signal indicative of the total volume pumped during a current pump cycle that may be used to deactivate the pump once a predetermined volume has been pumped. The flow meter also provides at least a second signal indicative of a total volume pumped once all fluid flow ceases through the fluid conduit monitored by the flow meter (i.e., through the pump). The second signal allows for monitoring additive volume pumped during pump coast. A controller is operatively connected to the pump and the flow meter. The controller is operative to activate and deactivate the pump according to an injection schedule. Specifically, the controller is operative to activate the pump and then deactivate the pump upon a pumped additive volume meeting or exceeding a pump cycle target volume for the current pump cycle. Once the pump is deactivated and all fluid flow has ceased, the controller calculates an actual volume of additive pumped based on the second output from the flow meter. Based on a difference between the actual volume of additive pumped versus a fixed cycle target volume, an adjusted pump cycle target volume is calculated. This adjusted pump cycle target volume is utilized for a subsequent pump cycle.

The pump utilized with the first aspect may be of any appropriate type. Non-limiting examples include diaphragm pumps, gear type pumps, piston pumps, rotary pumps etc. In further arrangements, pneumatic pumps may be utilized. In such pneumatic applications, the controller controls activation and deactivation of the pump by controlling a pneumatic actuator. Typically, the displacement of the pump is selected based on per cycle injection volumes required for a particular application.

The flow meter may be any flow meter that is operative to provide accurate flow measurements. To provide necessary accuracy, some arrangements utilize a positive displacement flow meter. Such positive displacement flow meters may include gear type flow meters that provide high accuracy in low flow applications.

The controller typically includes internal processing capabilities and the user interface that allows a user to input and/or view various operating parameters. Such operating parameters may include, without limitation, an injection period (e.g., days, hour, hours, minutes and seconds, etc.), a total injection volume for a specified injection period and/or a desired number of injection or pump cycles for the injection period. Based on these inputs or other pre-stored parameters the controller is operative to generate an injection schedule (e.g., once per minute, etc.) and a per pump cycle injection volume. The per pump cycle injection volume (e.g., target volume) may represent a fixed target injection volume against which actual injection volumes are measured.

In operation, the controller may be operative to compare an actual injection volume to a previous injection volume and/or the fixed injection volume to determine the difference between the actual injection volume and the prior or fixed injection volume. This difference may be utilized to calculate an adjusted injection volume for a subsequent pump cycle. In one arrangement, if the difference between an actual injection volume and a prior adjusted injection volume results in a negative injection volume for the next pump cycle, the pump may not be activated during the next pump cycle.

According to another aspect, a controller is provided for use with an injection pump and a flow meter that measures a volume of additive injected/pumped by the pump. The controller includes a computer, (e.g., processor and/or various memories) a user interface device, a pump control output module and a system interface. The user interface device provides communication between the user and the controller and allows the user to input data. A pump control output module is connected to a control system of the pump such that a control signal from the pump control output module cooperates with the control system to turn the pump on and off. In addition, a system interface is connected to the flow meter in order to receive signals from and/or poll the flow meter to identify volumes pumped during a pump cycle. The computer further includes stored programs or algorithms to affect specific processes. More specifically, the stored programs allow the controller to deactivate the pump after a pump cycle target volume has been pumped. Stored programs also allow the calculation of an actual pumped volume once fluid flow in fluid conduit monitored by the flow meter ceases. The controller is operative to calculate a difference between the actual measured volume and a target volume to generate an adjusted target volume for a subsequent pump cycle.

According to a further aspect, a software product is provided for use in an injection controller that controls an injection pump, which injects additive from an additive source into a hydrocarbon production conduit. Control of the pump is based at least in part on volumetric signals received from a flow meter. In this aspect, the software product may be incorporated into an existing controller. The software product includes instructions that allow the controller to calculate a pump cycle target volume and a pump activation schedule. The pump cycle target volume and pump activation schedule may be calculated based on one or more inputs received from a user. The software product allows the controller to generate an initial or fixed per pump cycle target volume for use during individual pump cycles of the pump. During a pump cycle, the software product allows the controller to activate a pump and then deactivate the pump once a pumped volume meets or exceeds the pump cycle target volume. After deactivating the pump, the software product allows the controller to calculate an actual pumped volume of fluid pumped during the pump cycle, calculate a difference between the actual pumped volume and the pump cycle target volume. Based on this difference, the software product allows the controller to generate an adjusted pump cycle target volume for a subsequent pump cycle.

According to a further aspect, a modified volumetric control utility is provided. In this modified utility, a pump may not be activated during one or more pump cycles to maintain an actual pumped volume for a number of completed pump cycles within a predetermined range of a target injection volume for the competed pump cycles. Again, the controller is operatively connected to an additive pump and a flow meter. The flow meter provides at least a first signal indicative of a volume pumped during a current pump cycle. The first signal is used to deactivate the pump once a predetermined or target volume for a pump cycle has been pumped. The flow meter also provides at least a second signal indicative of a total actual volume pumped once all fluid flow ceases through a fluid conduit monitored by the flow meter (i.e., through the pump). The controller calculates a cumulative actual volume pumped, which is a summation of the actual volumes pumped for all completed pump cycles. The controller also calculates a cumulative target volume for all completed pump cycles, which is the number of completed pump cycles times the per pump cycle target volume. Once the cumulative actual volume exceeds the cumulative target volume by more than the target volume of the next pump cycle, the next pump is not activated during the next pump cycle. That is, an injection is skipped.

DETAILED DESCRIPTION

The embodiments discussed herein are merely illustrative of specific manners in which to make and use the inventions and are not to be interpreted as limiting the scope of the presented inventions. While the inventions have been described with a certain degree of particularity, it is to be noted that many modifications may be made in the details of the construction and arrangement of the various components of inventions without departing from the spirit and scope of this disclosure. It is understood that the inventions are not limited to the embodiments set forth herein for purposes of exemplification.

Figure 1:
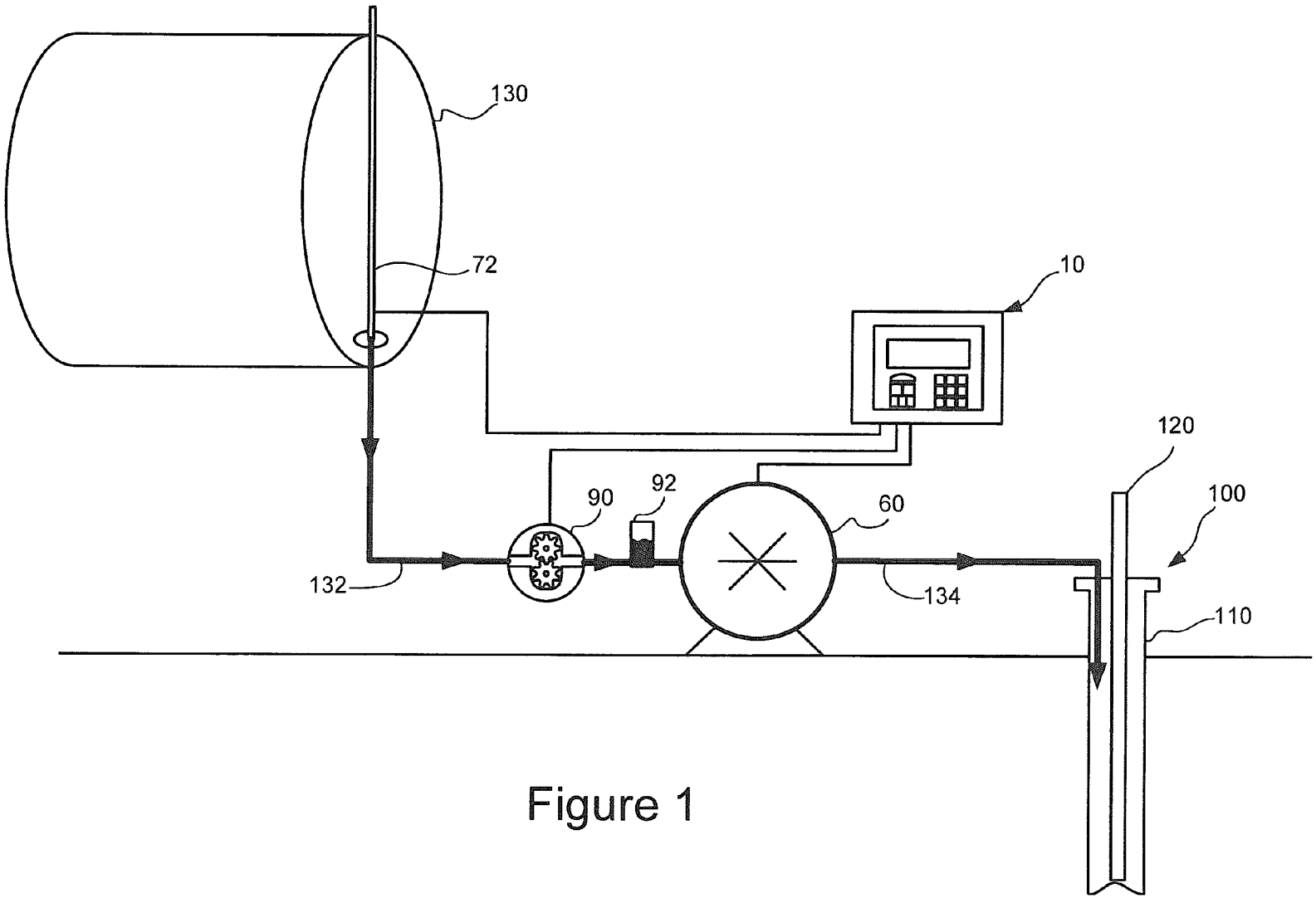
FIG. 1 illustrates a hydrocarbon additive injection system.

FIG. 1 is an exemplary diagram of a well site incorporating an additive injection system. As illustrated, the system is operative to inject chemical or additives (hereafter additives) into a wellbore 100. In other embodiments, it will be appreciated that the injection system may inject additives into other productions systems (e.g., pipelines etc.). The wellbore 100 may be a production well having any completion equipment and a subterranean production zone (not illustrated), which typically includes multiple perforations through the casing 110 of the well bore 100. Such perforation allow hydrocarbons (e.g., gas, oil) to enter into the casing. Production tubing 120 is utilized to remove the hydrocarbons from the wellbore casing. That is, smaller diameter production tubing 120 is inserted into the casing and is used to carry the fluid from the production zones to the surface. Various wellhead equipment may be included such as blow-out preventers, valves, storage tanks, pipelines etc (not shown) as is well known in the art and thus are not described in greater detail.

As shown in FIG. 1, a fluid additive is stored in an additive storage tank 130 (e.g., source) and is injected into the wellbore 100 via a suitable pump 60, such as a positive displacement pump. More specifically, an inlet of the pump 60 is connected to the additive storage tank 130 via a first fluid conduit 132 and an outlet of the pump 60 is connected to the wellbore via a second fluid conduit 134. The pump is operated by an electric motor. During operation of the pump, the additive flows through the conduits 132, 134 and discharges into the well bore casing 110. In the illustrated embodiment, the additives are discharged in the casing near the surface. However, it will be appreciated that the additives may be discharged at a subterranean location near the production zone via appropriate tubing or conduits. Further, multiple additive sources may be provided via separate injection lines to allow for injection of different additives. The same also holds for injection of additives in pipelines or surface processing facilities.

As shown, a flow meter 90 (such as gear-type meter or a nutating meter) measures the flow rate through the first fluid conduit 132 provides signals representative of the volume passing through the fluid conduit. The flow meter 90 generates an output signal indication of a volume of additive passing through the conduit during each injector cycle. The flow meter may be reset after each injection cycle to provide an accurate per cycle volume measure. In one embodiment a Blancett® Model B 1750 positive displacement flow meter is utilized. This meter typically utilizes a large gear ratio (e.g., 13000:1) to provide high accuracy at low flow rates. However, other flow meters may be utilized. The flow meter 90, in the present embodiment, is located in the first fluid conduit 132 upstream of the pump 60. Such an arrangement has been found to provide improved volume measuring accuracy as the flow meter 90 is not subject to pressure variations/pulsating flows caused by the pump at locations downstream from the pump. However, it will be noted that in other embodiments, the flow meter may be located downstream of the pump.

To further improve accuracy of the flow meter 90, one embodiment of the system incorporates a pulsation dampener 92 that is disposed between the flow meter 90 and the pump 60. As noted, pumps typically produce pulsating flows. This is especially evident in reciprocating positive displacement pumps. In the absence of a pulsation dampener, the pulsating flows or pressure spikes caused by the pump can reverberate though the fluid conduit 132 between the pump 60 and the flow meter 90. This is true even when the flow meter 90 is disposed upstream of the pump 60. These pressure variations affect the accuracy of the flow meter volume measurements. When volumes measured by the flow meter are very small, the effect of the pulsating flows can lead to significant inaccuracies in the volume measurements. Accordingly, the pulsation dampener may be utilized to substantially isolate the flow meter 90 from pressure variations caused by the pump 60. The pulsation dampener 92 is an in-line device that dampens pressure variations in the fluid conduit 132 or 134 to prevent their continued propagation. In the illustrated embodiment, the pulsation dampener 92 is a gas-filled vessel that absorbs pressure variation caused by the pump by alternately compressing and expanding a gas cushion in synchronization with the motion of the pump. The gas cushion is normally an inert gas (e.g., nitrogen) that is separated from the fluid by a flexible membrane (i.e. bladder, diaphragm or bellows). Exemplary pulsation dampeners are available from Flowguard USA, of Houston Tex. However, any appropriate flow dampening device may be utilized.

An onsite injection controller 10 controls the operation of the pump 60, either utilizing programs stored in a memory associated with the controller 10, instructions entered by a user and/or using instructions provided to the controller 10 from a remote location. The injection controller 10 controls when the injection pump 60 turns on and off in order to inject a predetermined volume of additive into a subterranean hydrocarbon gas or oil well or associated production and process systems in either a single batch or more commonly in multiple cycles per day (e.g., pump cycles, injection cycles). The controller 10 uses a stored program containing instructions that control the pump 60 (e.g., activate and deactivate) based on a total volume of additive to be injected over a predetermined or user set time period (e.g. one day) and a predetermined or user set number of injection cycles. More specifically, the controller is operative to activate the pump until a desired volume of additive passes through the flow meter 90 at which time the pump 60 is deactivated. This operation is more fully discussed below. That is, the controller implements a volumetric control that allows for, among other things, eliminating the need to perform an injection rate test data or otherwise account for well specific and/or pump specific variables. Stated otherwise, the volumetric control allows for injecting a desired volume of additive irrespective of individual wellhead considerations or specific pump operating characteristics.

Figure 2:
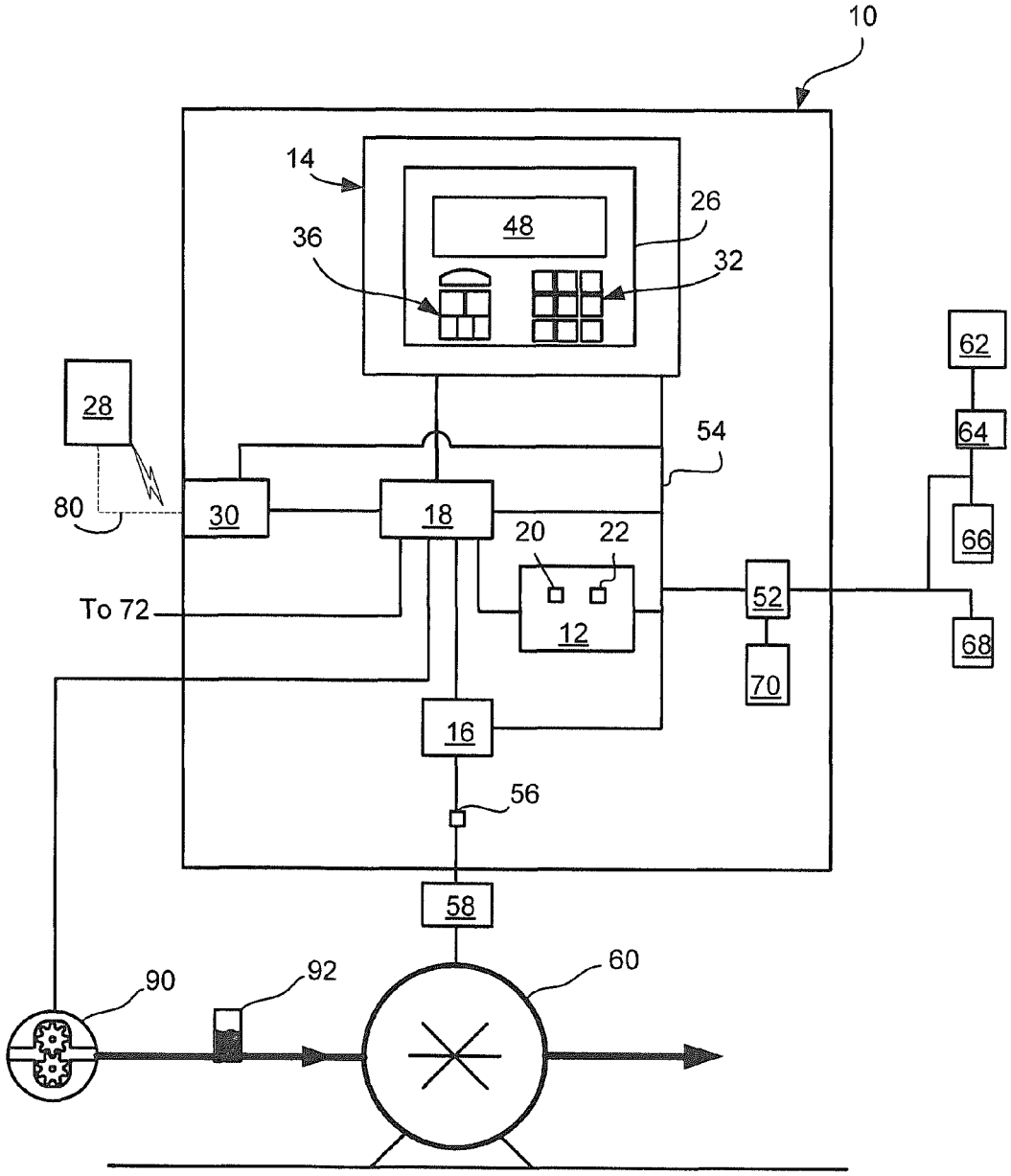
FIG. 2 illustrates a block diagram of one embodiment of a controller of a hydrocarbon additive injection system.

FIG. 2 shows an overall block diagram of the controller 10. As shown, the injection controller 10 has a computer 12, a user interface device 14, a pump control output module 16, a system interface device 18, a power interface module 52, a power bus 54 and, typically, one or more internal batteries 70. The controller 10 may take power from a conventional AC or DC power supply 68 (e.g., utility electric line) that is connected to the power interface module 52. The power interface module 52 converts received AC or DC power to a predetermined power configuration. The power interface module 52 is connected to the power bus 54 to provide the predetermined power to the power bus 54. The power bus 54 is connected to the computer 12, the user interface device 14, the controller 10, the pump control output module 16 and the system interface device 18 to supply the predetermined power to these components. As will be appreciated, the power supply may also be connected to the pump 60. The internal battery 70 is also connected to the power interface module 52 to serve as a temporary source of electrical power if other power is not available. The controller 10 may alternatively take electrical power from a solar panel, wind turbine or other electric generator 62 through a power controller 64 and/or an external storage battery 66 where such an alternate or non-conventional power source is connected to the power interface module 52 either instead of or in addition to conventional power. Likewise, the pump 60 may be connected to a non-conventional power source.

The user interface device 14 provides communication between the user and the controller 10 by allowing the user to input the user input data, to input user instructions and to see status data. Typically, a user inputs information regarding an injection period, total volume to be injected during the injection period and the frequency or number of injections during the injection period. By way of example only, a user may specify an injection period of 1 day for 1 L of additive to be injected in discrete injections once per minute (e.g. 1440 times a day). The controller 10 then uses the user input data to determine a per injection volume (e.g., target volume) required to achieve the specified total volume over the specified injection period. For instance, 1440 injections (i.e., once per minute for 24 hours) would result in a target injection volume of 0.00069444 L per injection. After the controller 10 calculates the target injection volume, the controller is operative to activate and deactivate the pump 60 on the specified injection schedule (e.g., once per minute) to deliver the target injection volume. More specifically, the controller activates the pump until the flow meter 90 indicates that the volume pumped by the pump meets or exceeds the per cycle target volume, at which time the pump is deactivated.

The pump control output module 16 is connected to the pump control system 58 (e.g., relay switch) of the injection pump 60 such that a signal from the pump control output module 16 cooperates with the control system of the injection pump 60 to turn the injection pump on and off. In the one embodiment, the pump control output module 16 is connected to the injection pump control system 58 through at least one intrinsically safe electrical barrier 56. In another embodiment, the connection between the controller 10 and other components, like the injection pump control system 58, is made using conduit and conduit fittings with wiring received inside the conduit and conduit fittings that suitable for use in and around the area of a wellhead, which may have a hazardous area classification of a Class I, Group D, Division 1 or 2 location as defined in the National Electric Code, that is often referred to in the petroleum industry as an 'explosion-proof' wiring system. Though discussed primarily in relation to the control of an electric pump, it will be appreciated that the controller may also control the activation and deactivation of a pneumatic pump by controlling a pneumatic actuator.

The system interface device 18 is connected to the computer 12, to the user interface device 14, to the pump control output module 16 and the flow meter 90. The system interface device 18 receives the user input data and the user instructions from the user interface device 14 and transmits the user input data and the user's instructions to the computer 12. Likewise, the system interface device 18 relays commands from the computer 12 to the pump control output module 16. Additionally, the system interface device relays signals from the flow meter 90 to the computer 12. As will be appreciated, the flow meter output signals may be provided to the computer 12 or the computer may poll the flow meter.

The computer 12 in the controller 10 includes a Central Processor Unit 20 (CPU) and a memory 22. The memory 22 may include read only memories (ROM) for storing programs, tables and models, and random access memories (RAM) for storing data. The memory 22 holds a stored program or algorithm where the stored program is used to determine the per cycle target injection volume for the injection pump 60 in order to inject a predetermined amount of a additive into a well over correct number of cycles. Additionally, the memory holds a stored program or algorithm for altering the per cycle injection volume as more fully set forth below.

In the illustrated embodiment, the user interface device 14 is a local user interface panel 26. As can be seen from FIG. 2, the local user interface panel 26 further comprises a display 48 and one or more keypads 32, 36 where the display 48 and the keypads 32, 36 cooperate to provide local communication between user and said controller 10 such that user can input the user input data into the controller 10, can input the user instructions into the controller 10 and the controller 10 can show status data. The exact configuration of the controller interface may be varied.

In another embodiment, the user interface device 14 includes an optional communication module 30 and a remote control and status station 28 for remote control of the controller 10. In such an embodiment, the communication module 30 may receives the user input data from and/or transmits status data to the remote control and status station 28. The communication module 30 is connected to the system interface device 18 such that the system interface device 18 receives the user input data and user instructions from the communication module 30, transmits the user input data and user instructions to the computer 12 and transmits the status data to the communication module 30. Communication between the communication module 30 and a remote control and status station 28 may be accomplished by standard phone line link 80, cellular-telephone link or by satellite radio link where the communication module 30 has a modem, a cellular-telephone transceiver or a satellite radio transceiver depending on the link used. Additionally, radio frequency (RF) communications may be utilized.

In another embodiment, the injection controller 10 is connected to an optional additive storage tank level transducer 72 where the storage tank level transducer 72 is in fluid communication with the additive inside the additive storage tank such that the additive tank level transducer 72 generates an input in response to the level of the additive in the storage tank. The storage tank level transducer 72 is connected to the system interface device 18 to provide an input to the computer 12 that indicates that the additive tank is empty so that the computer 12 may deactivate the pump 60.

The ability to volumetrically control the injection pump 60 operation based on a measured pumped volume allows the controller to be incorporated with any pump. Accordingly, the controller 10 may be retrofit to existing pumps. That is, no specialized pump is required. However, it has been recognized that simple volumetric control can lead to certain inefficiencies. For instance, many pumps continue to operate for a short duration after power to the pump is shut off. Stated otherwise, many pumps coast to a stop after power is shut off and continue to pump additive as they coast to a stop. This is especially apparent in pumps that utilize a brushed motor, however, it also is present in pumps utilizing brushless motors, albeit to a lesser extent.

Figure 3:
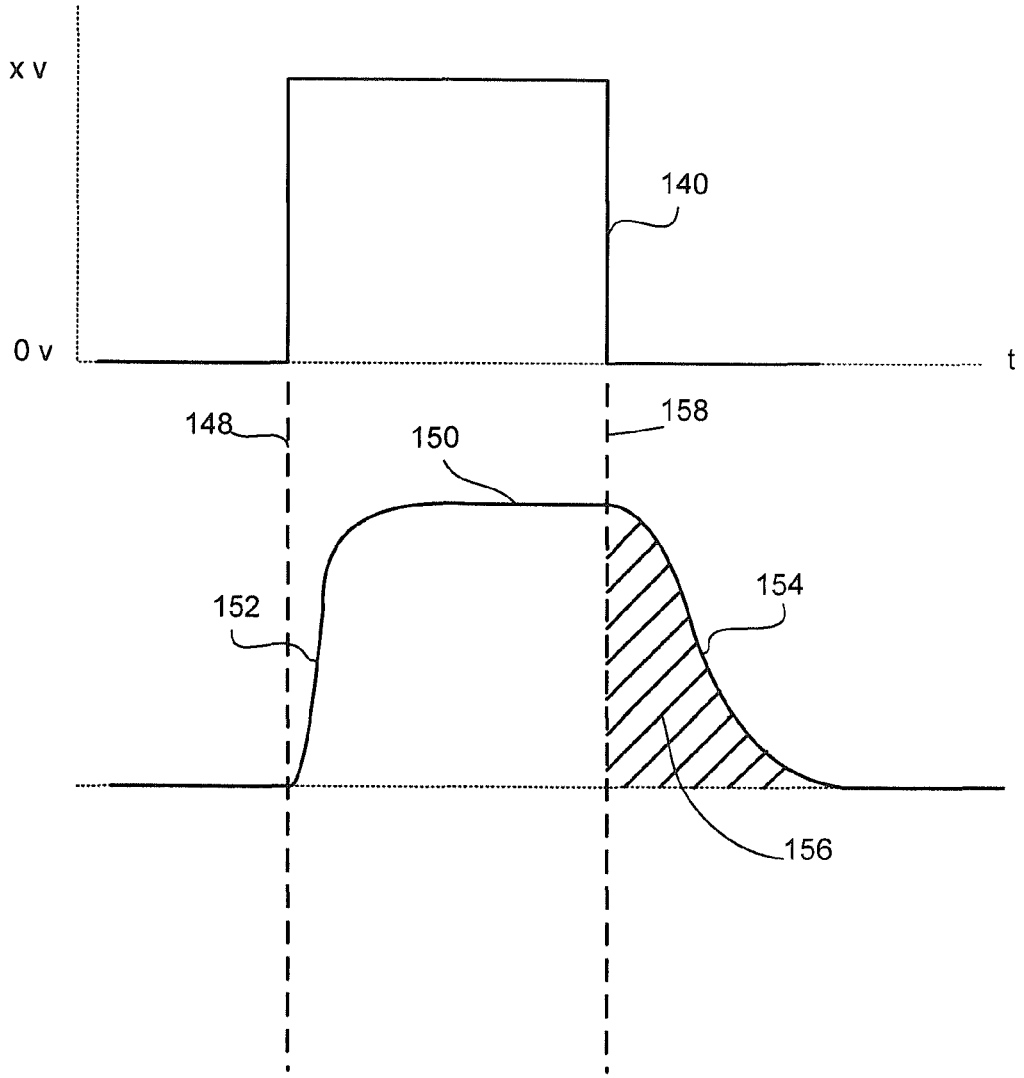
FIG. 3 illustrates a pump control signal and a pump output volume.

FIG. 3 illustrates continued pumping (i.e., pump coast) after pump shut down. As shown, a control signal 140 generated by the controller 10 is provided to the pump control system 58. Such a signal may be represented as a square wave where power is either on or off for an operation duration (t). In contrast, when power is applied to the pump 60, (i.e., power activation line 148) the pump has to overcome inertia to begin pumping and ramps up to a steady state operation as illustrated by the upward slope 152 of pump operation curve 150. The inertia of the pump also results in continued pump operation, when power is terminated, as shown by the downward slope 154 of curve 150. As illustrated, the area under the pump operation curve 150 represents the total volume pumped during operation of the pump. The shaded area 156, below the pump curve 150 and beyond power deactivation line 158, graphically represents an excess volume of additive pumped during the pump cycle.

The excess volume additive pumped during shutdown of the pump motor is of little consequence when additives are injected in a few long pump cycles over a large time period (e.g., four cycles per day). In such instances, the excess volume may represent a small fraction of the total volume. However, in injection applications having hundreds or thousands of short injection cycles (e.g., 1440 cycles per day; once per minute as per current industry standard in gas well production), the cumulative effect of the additional volume of additives pumped during shutdown/pump coast can lead to significant over injection of such additives. It has been found that excess injection resulting from pump coast in applications having hundreds or thousands of injection cycles for low volume injections often results in total injection volumes of 140%-250% of a target injection volume. As will be appreciated, this over injection of additives is wasteful and can lead to significant increased operating expenses especially for large operators who maintain hundreds or thousands of wells.

The following table illustrates actual volumes injected in a ten (10) cycle injection process utilizing a simple volumetric control where pump operation is terminated after a target volume is pumped as determined by a flow meter. In the following table, a target injection volume (i.e., target cycle volume) for each cycle is 0.1 L to produce a cumulative injection volume of 1 liter:

TABLE 1

| | Cycle | | | | | | | | | | Volume |
|---|---|---|---|---|---|---|---|---|---|---|---|
| | 1 | 2 | 3 | 4 | 5 | 6 | 7 | 8 | 9 | 10 | Totals |
| Target Cycle Volume | 0.1 | 0.1 | 0.1 | 0.1 | 0.1 | 0.1 | 0.1 | 0.1 | 0.1 | 0.1 | 1 |
| Measured Cycle Volume | 0.46 | 0.24 | 0.24 | 0.13 | 0.15 | 0.15 | 0.16 | 0.19 | 0.17 | 0.19 | 2.08 |
| Cycle Difference | −0.36 | −0.14 | −0.14 | −0.03 | −0.05 | −0.05 | −0.06 | −0.09 | −0.07 | −0.09 | |

As shown, simple volumetric pump control where pump operation is terminated after pumping a target cycle volume results in significant over injection during each cycle. More specifically, during each pump cycle, the pump is activated and the flow meter reads the volume of the additive entering (or exiting) the pump until the measured flow volume exceeds the target cycle volume. The pump is then disengaged but the flow meter continues to measure the volume of additive that is being injected as the pump slows to a stop. After the flow meter is no longer measuring positive fluid movement, the total or actual volume is evaluated (i.e., measured cycle volume). As shown, the total measured volume injected during the ten injection cycles is over double (i.e., 2.08) the target injection volume due to pump coast.

To alleviate the over injection caused by pump coast, aspects of the presented utilities utilize what is referred to as "Predictive Pump Coast" (PPC) to reduce over injection. PPC measures the actual volume pumped during a pump cycle and compares the actual volume to a fixed target volume for the pump cycles. If the actual volume exceeds the fixed target volume for the pump cycle, an adjusted cycle volume is calculated for the subsequent cycle. By way of example only, if a fixed target volume for a pump cycle is 0.1 L and an actual volume pumped during a pump cycle is 0.12 L, the subsequent pump cycle (e.g., second pump cycle) may utilize an adjusted cycle volume of 0.08 L. Accordingly, the actual volume pumped during the subsequent pump cycle may be again compared to the original fixed target volume in order to further adjust the next pump cycle. Continuing with the above-noted example, if the second pump cycle pumps an actual volume of 0.11 L, (i.e., 0.01 L in excess of the fixed target volume; 0.11 L-0.1 L) the adjusted cycle volume may be further reduced to, for example 0.07 L for the next (e.g., third) pump cycle. As will be appreciated, the ability to adjust the cycle volumes for pump cycles provides a means for accounting for pump coast during pump shut down. Specifically, during a pump cycle, the pump is activated and the flow meter reads the volume of the chemical or additive entering (or exiting) the pump until the measured flow volume exceeds the fixed target volume on the first pump cycle (or adjusted cycle volume for subsequent cycles). The pump is then disengaged but the flow meter continues to measure the volume of additive that is being injected as the pump slows to a stop. After the flow meter is no longer measuring positive fluid movement, the total or actual volume is evaluated and compared to the fixed target cycle volume such that additional adjustment may be made to the adjusted cycle volume. This iteratively fine tunes the adjusted cycle volume such that upon pumping the adjusted cycle volume and deactivating the pump, the total volume pumped by the pump while active and during pump coast will approach the fixed target cycle volume.

The following table illustrates actual volumes injected in a ten (10) cycle injection of 1 liter of additive where a target injection for each cycle is 0.1 L and the injection system utilizes the predicative pump coast methodology:

TABLE 2

| | Cycle | | | | | | | | | | Volume |
|---|---|---|---|---|---|---|---|---|---|---|---|
| W/PPC | 1 | 2 | 3 | 4 | 5 | 6 | 7 | 8 | 9 | 10 | Totals |
| Target Cycle Volume | 0.1 | 0.1 | 0.1 | 0.1 | 0.1 | 0.1 | 0.1 | 0.1 | 0.1 | 0.1 | 1 |
| Adjusted Cycle Volume | 0.1 | 0.02 | −0.04 | 0.06 | 0.07 | 0.05 | 0.05 | 0.04 | 0.01 | 0.03 | |
| Measured Cycle Volume | 0.18 | 0.16 | 0 | 0.09 | 0.12 | 0.1 | 0.11 | 0.13 | 0.08 | 0.12 | 1.09 |
| Cycle Difference | −0.08 | −0.06 | 0.1 | 0.01 | −0.02 | 0 | −0.01 | −0.03 | 0.02 | −0.02 | |
| New Adjusted | 0.02 | −0.04 | 0.06 | 0.07 | 0.05 | 0.05 | 0.04 | 0.01 | 0.03 | 0.01 | |

TABLE 2-continued

| | Cycle | | | | | | | | | | Volume |
|---|---|---|---|---|---|---|---|---|---|---|---|
| W/PPC | 1 | 2 | 3 | 4 | 5 | 6 | 7 | 8 | 9 | 10 | Totals |
| Cycle Volume | | | | | | | | | | | |

As shown, by adjusting the target volume for each cycle, at the end often injection cycles the total volume injected is only 9% greater than the total target volume.

Still referring to the data of Table 2, the fixed target cycle volume for each cycle is 0.1 liters. After the initial pump cycle (i.e., once the pump has ceased operation and there is no flow in the fluid conduit monitored by the flow meter), the actual volume pumped (i.e., measured cycle volume) during the first cycle is measured at 0.18 liters. The cycle difference between the measured cycle volume (0.18 L) and the fixed target cycle volume (0.1 L) is −0.08 liters. That is, an excess of 0.08 liters was pumped during the first pump cycle. This difference is removed from the initial adjusted cycle volume of 0.1 L (which is initially set to the fixed target cycle volume) to produce an adjusted cycle volume of 0.02 liters for the second pump cycle. Accordingly, during the second pump cycle, the pump is activated until the flow meter reads the volume of additive entering (or exiting) the pump meets or exceeds 0.02 liters, at which time the pump is deactivated. Once the flow through the fluid conduit ceases (i.e., the pump has stopped) the volume for the second pump cycle is measured (i.e., measured cycle volume). In this instance, the measured second cycle volume is 0.16 a difference of −0.06 from the fixed target cycle volume of 0.1. This difference is removed from the first cycle adjusted cycle volume 0.02 to generate a third cycle adjusted cycle volume. In the present example, this difference reduces the third cycle adjusted cycle volume to less than zero (i.e., 0.02−0.06=−0.04). In this situation, the pump is not activated during the third cycle. This results in a zero measured cycle volume and a difference of +0.1. Accordingly, this difference is added to the third cycle adjusted target volume −0.4 to generate a fourth cycle adjusted cycle volume of 0.06. (i.e., −0.4+0.1=0.06). The process continues for the remainder of the pump cycles.

Figure 4:
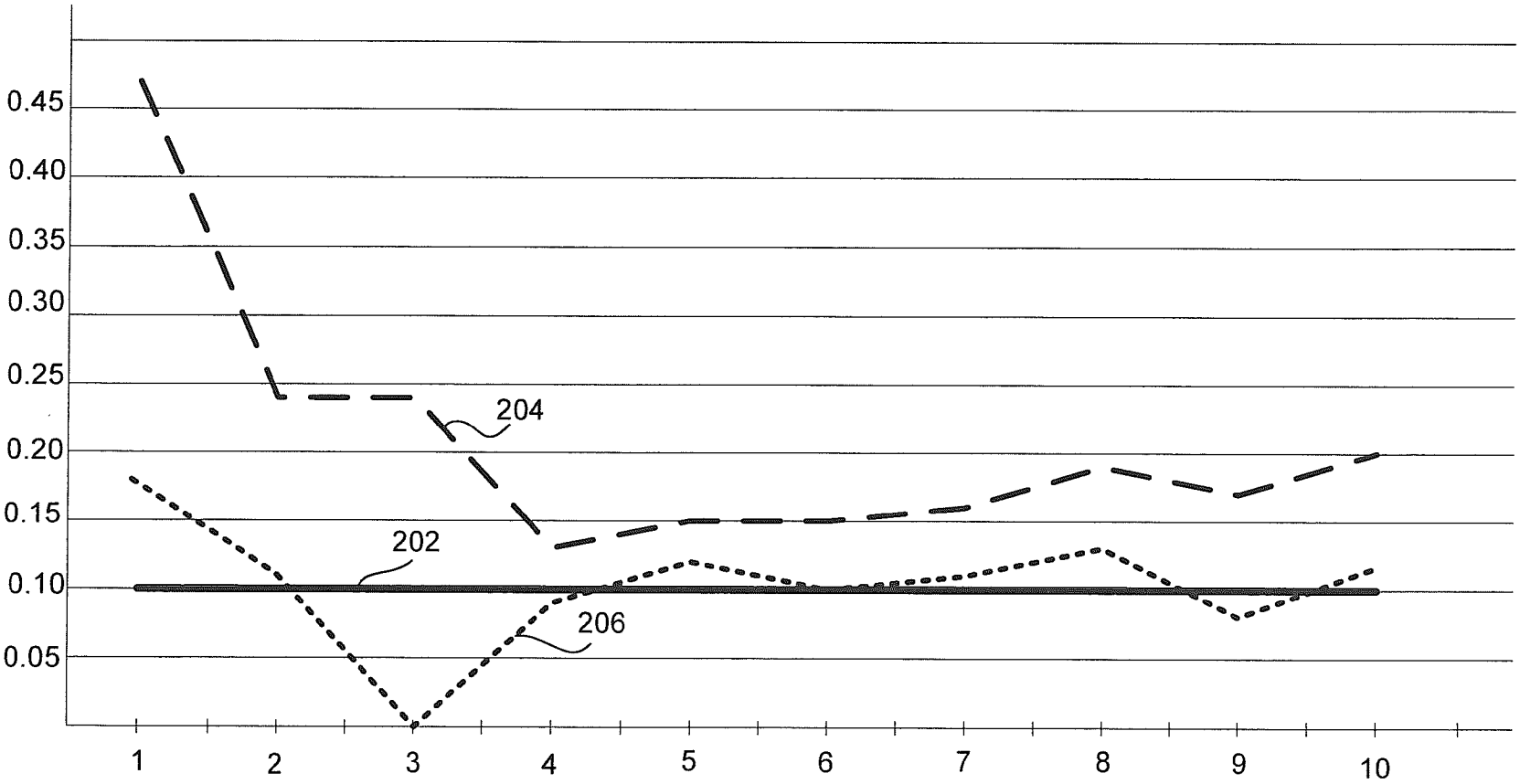
FIG. 4 is a graph of per cycle injection rates versus a target injection rate.
Figure 5:
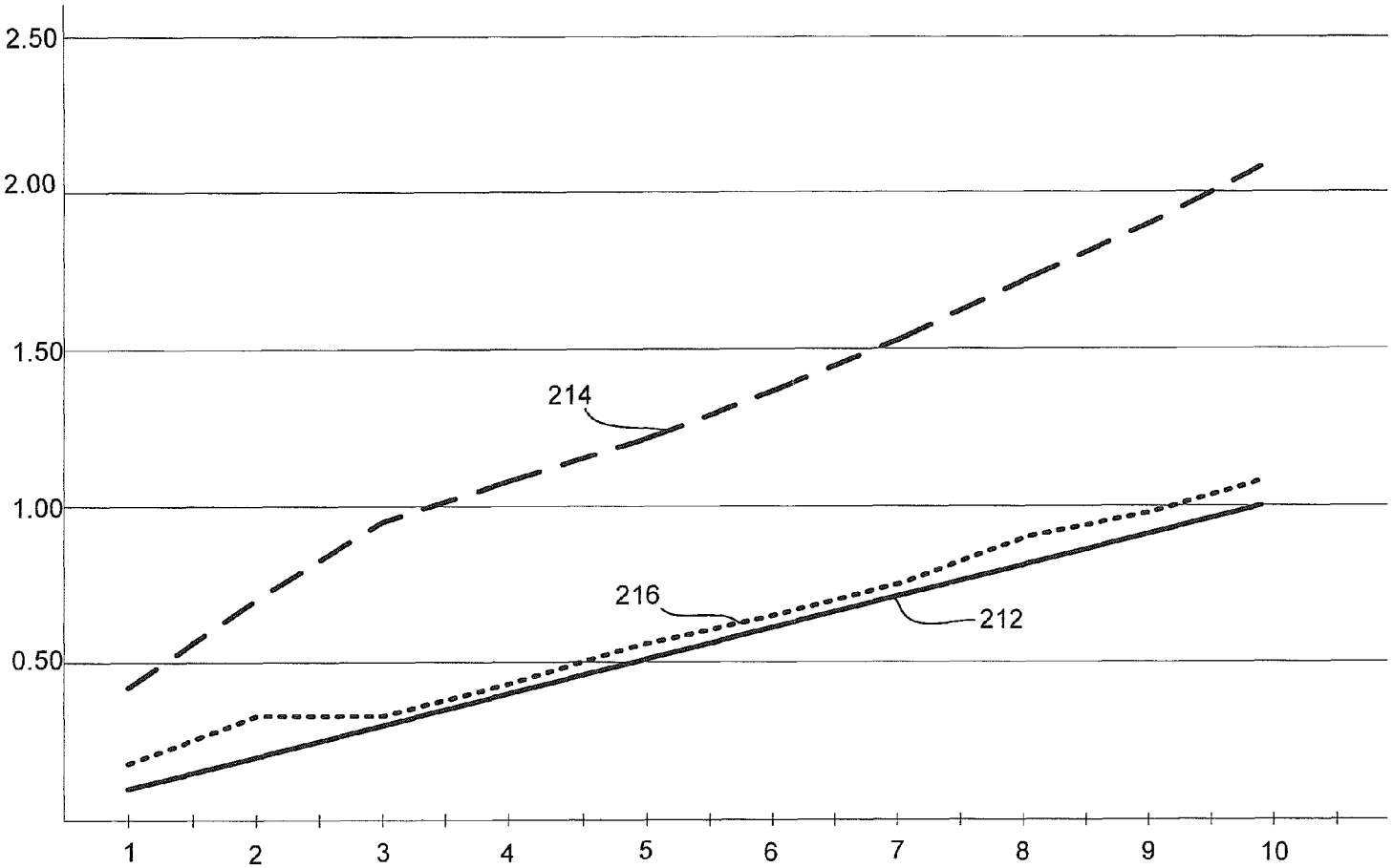
FIG. 5 is a graph of cumulative injection volumes verses a cumulative target injection volume.

The results of the data from tables 1 and 2 are plotted in FIGS. 4 and 5. Specifically, FIG. 4 illustrates the target cycle volumes without PPC 204, with PPC 206 in comparison to the fixed per cycle target volume 202. As shown, the fixed target volume 202 remains constant at 0.1 throughout the ten pump cycles. Volumetric control without PPC 204 results in significant over injection during each of the pump cycles. In contrast, PPC 206 results in an iterative over injection and under injection that better approximates the fixed target cycle volume. As a result, over injection is significantly reduced. This is illustrated in FIG. 5, which shows a running total volume by cycle. As shown, the target volume 212 increases by a fixed amount (0.1 L) each cycle. In contrast, the running total volume or cumulative volume of the volumetric control without PPC 214 increases at a significant rate in excess of the target volume 212. In contrast, the cumulative volume produced through volumetric pump control with PPC 214 closely approximates the target volume.

Figure 6:
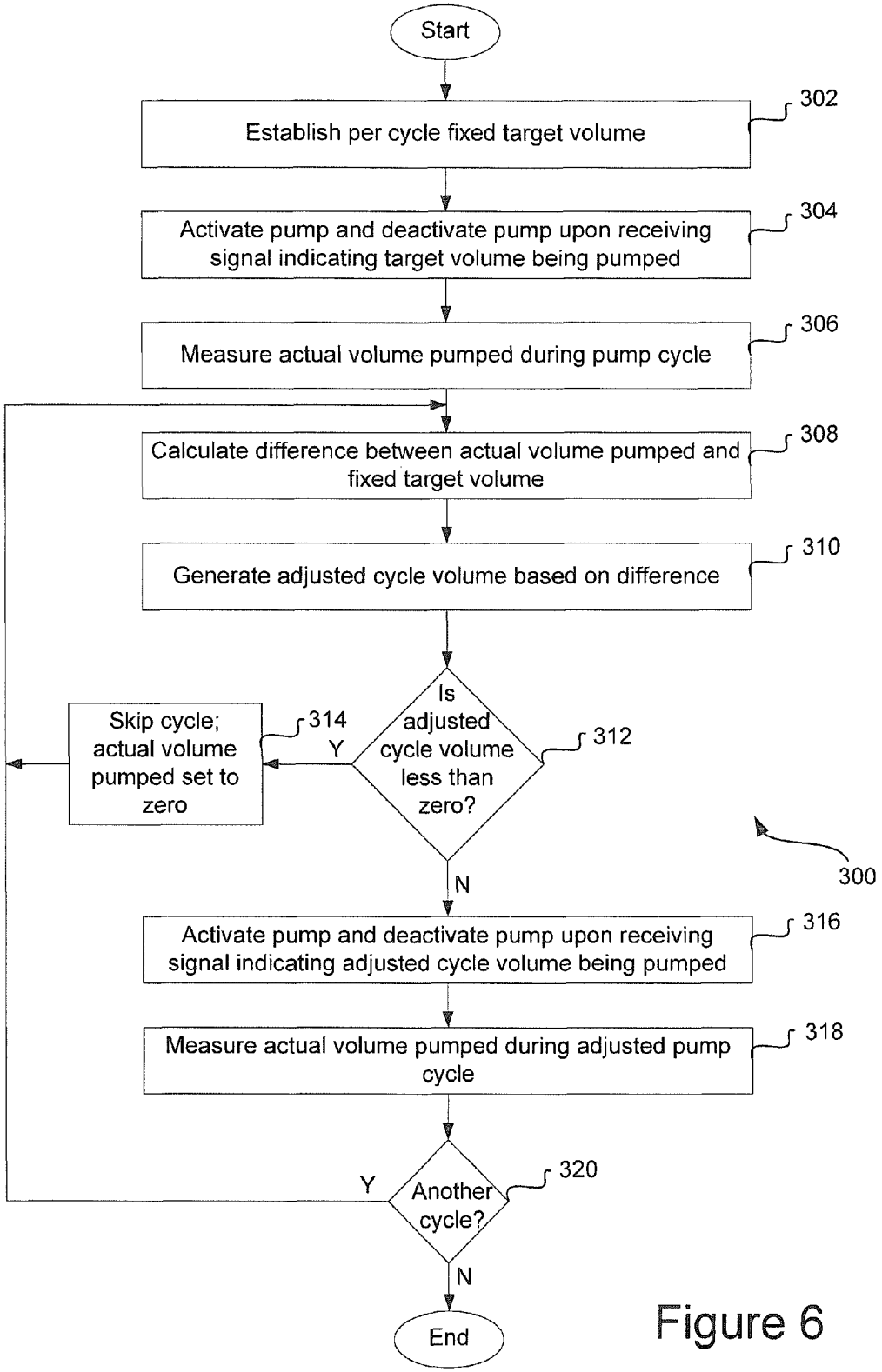
FIG. 6 is a process flow sheet of one embodiment of a volumetric control process that may be implemented by an additive injection system controller.

FIG. 6 illustrates a process 300 that may be implemented by the controller (e.g., as an algorithm or software program). While the aspects described herein are in the general context of computer-executable instructions of computer programs and software that run on computers (e.g., controller, etc.), those skilled in the art will recognize that the process 300 also can be implemented in combination with other program modules, firmware and hardware that perform particular tasks. The illustrated process 300, is one implementation of the PPC process discussed above. This process 300 may be incorporated into a OEM system having a specified controller, pump and flow meter. However, it will be further appreciated that the process may be implemented in a controller that is utilized with an existing pump and, if available, existing flow meter. Finally, it will be appreciated that the process may be implemented as a set of computer-executable instructions that may be stored or downloaded to an existing controller having appropriate controller inputs and outputs.

The process begins with establishing 302 a per cycle fixed target volume. As noted, establishing such a fixed target volume may include receiving various user inputs identifying a specified total injection volume over the specified injection period and/or a desired number of injections/pump cycles. Typically, the fixed target volume is calculated by dividing the total injection volume by the number of desired injections. Once the per cycle fixed target volume is established 302, the process includes activating and deactivating 304 an injection pump upon receiving a signal from a flow meter indicating a target volume has been pumped or injected. That is, the pump is operated until the pumped volume meets or exceeds the fixed target volume as measured by the flow meter. Once all fluid flow ceases through a fluid conduit monitored by the flow meter, an actual volume pumped during the pump cycle is measured 306. Measuring the actual volume pumped after cessation of all fluid flow through the fluid conduit allows for measuring excess volume due to pump coast after deactivation of the pump. Once an actual volume pumped during the pump cycle is measured, a difference between the actual volume pumped and the fixed target volume is calculated 308. Based on this difference, the process includes generating 310 an adjusted cycle volume. For instance, the adjusted cycle volume may represent a reduction of the fixed target volume after the first pump cycle by the difference of the actual pumped volume and the fixed target volume. In subsequent pump cycles, a previous adjusted cycle volume may be further adjusted based on the difference. Optionally the process may determine 312 if the adjusted cycle volume is less than zero. If so, the pump is not activated during the next pump cycle. Stated otherwise, the pump is deactivated 314 during the next pump cycle. Once adjusted cycle volume is generated, the process again includes activating and deactivating 316 the injection pump upon receiving a signal from the flow meter indicative that the adjusted cycle volume has been pumped. After all fluid flow ceases through a fluid conduit monitored by the flow meter, an actual volume pumped during the pump cycle is measured 318. The process then determines 320 if there is another pump cycle for the injection period. If the injection period does include another pump cycle 320 the process steps of 308 through 320 are iteratively repeated. After all of the pump cycles are completed for injection period, the process 300 ends.

While PPC allows for adjusting the pumped volume to iteratively estimate an adjusted pump cycle volume to pump in order to achieve a desired fixed target volume, it will be appreciated that variations may be made to the overall process. For instance, use of the flow meter to measure actual flows after fluid flow through monitored fluid conduit ceases allows for a modified process that, instead of adjusting subsequent pump volumes, skips injections until an actual or measured pumped volume substantially aligns with the target volume. Such a modified process may be implemented in an injection process having multiple (e.g., hundreds or thousands) of injection cycles where periodically skipping in injection cycle is permissible.

Figure 7:
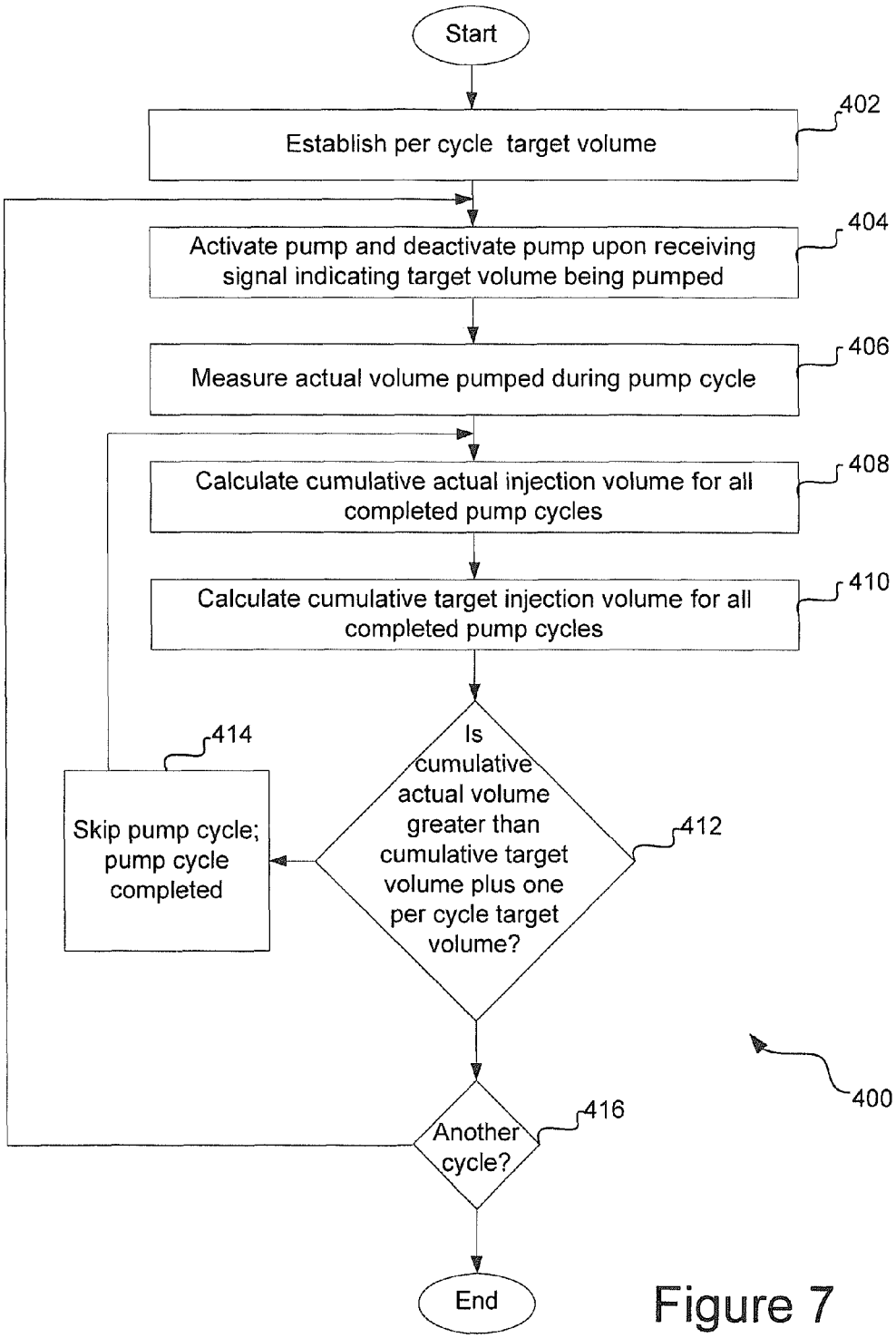
FIG. 7 is a process flow sheet of another embodiment of a volumetric control process that may be implemented by an additive injection system controller.

FIG. 7 illustrates modified volume control process 400. Initially, the process 400 includes establishing 402 a per cycle fixed target volume. As above, establishing such a per cycle fixed target volume may include establishing a total injection volume and number of pump cycles for an injection period. Once the per cycle fixed target volume is established, the process includes activating and deactivating 404 an injection pump upon receiving a signal from a flow meter indicating that the target volume has been pumped. Once all fluid flow ceases through a fluid conduit monitored by the flow meter, an actual volume pumped during the activation and deactivation of the pump (i.e., pump cycle) may be measured 406. At this time, the process includes calculating 408 a cumulative total measured or actual injection volume after the last completed pump cycle. Once the total actual injection volume is calculated, this value may be compared to a calculated 410 cumulative target volume for all completed pump cycles (e.g. cumulative pump cycles multiplied by per cycle target volume). The process 400 then determines 412 if the cumulative actual injection volume for all completed cycles exceeds the cumulative target volume for all completed pump by more that one fixed per cycle target volume (i.e., the target volume for next pump cycle). If so, the pump is deactivated 414 during the next pump cycle. While skipping the injection, the pump cycle is considered completed for purposes of calculating the cumulative target volume. Any time the cumulative measured volume is not greater than the cumulative target volume plus one cycle target volume, the process 400 continues 416 until all injection cycles are complete.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed:

1. An injection system operative to controllably inject an additive into a hydrocarbon production conduit, comprising:

a pump fluidly connected to an additive source and a hydrocarbon production conduit, said pump being operative to inject additive from said additive source into said hydrocarbon production conduit;

a flow meter disposed in a fluid conduit connecting said additive source and said hydrocarbon production conduit, said flow meter providing output signals representative of fluid volumes pumped by said pump during and after a pump cycle, wherein activation and deactivation of said pump defines the pump cycle;

a controller operatively connected to said pump and said flow meter and configured to inject a total injection volume of the additive over an injection period and in a plurality of discrete pump cycles, said controller being further operative during each discrete pump cycle to:

activate said pump;

deactivate said pump upon a volume of additive pumped during said discrete pump cycle equaling or exceeding a pump cycle target volume for said discrete pump cycle as indicated by a first output signal of said flow meter;

calculate an actual volume of said additive pumped once fluid flow in said fluid conduit ceases as indicated by a second output signal of said flow meter; and adjust said pump cycle target volume based on a difference between said actual volume and a fixed cycle target volume to produce an adjusted pump cycle target volume, wherein:

said pump cycle target volume is reset to said adjusted pump cycle target volume for a subsequent discrete pump cycle if the difference is less that said fixed cycle target value; and wherein the pump is inactive during the subsequent discrete pump cycle if the difference between said actual volume and said fixed cycle target volume exceeds said pump cycle target volume.

2. The system of claim 1, wherein said fixed cycle target volume comprises said total injection volume divided by said number of pump cycles for said injection period.

3. The system of claim 1, wherein said flow meter is disposed in said fluid conduit upstream of said pump.

4. The system of claim 1, further comprising;

a pulsation dampener disposed between said flow meter and said pump.

5. The system of claim 1, wherein said flow meter comprises a positive displacement flow meter.

6. The system of claim 1, wherein said pump comprises a brushed motor pump.

7. The system of claim 1, wherein said controller is further operative to:

receive user inputs identifying a total injection volume of said additive for an injection period and a number of pump cycles for said injection period.

8. The system of claim 1, wherein said flow meter is reset once fluid flow in said fluid conduit ceases.

9. The system of claim 1, wherein said hydrocarbon production conduit comprises one of:

a well bore; and a pipeline.

10. A controller operative to controllably inject an additive into a hydrocarbon production conduit, the controller being operatively connected to a pump and a flow meter measuring additive passing through the pump, comprising:

a user interface providing communication between a user and the controller, wherein said user interface is operative to receive user inputs;

a pump control output module operative to activate and deactivate a pump;

a system interface operatively connected to a flow meter for receiving signals from the flow meter indicative of volumes of additive passing through the pump;

a computer connected to said user interface, said pump control output module and said system interface, the computer further comprising a stored program containing instructions to:

calculate a pump cycle target volume and pump activation schedule;

generate a pump activation signal to activate the pump according to said pump activation schedule;

generate a pump deactivation signal to deactivate the pump upon a volume of additive pumped during a discrete pump cycle equaling or exceeding said pump cycle target volume as indicated by a first output signal received from said flow meter, wherein activation and deactivation of the pump defines a discrete pump cycle; and calculate an actual volume of said additive pumped during the pump cycle once fluid flow in said fluid conduit ceases as indicated by a second output signal received from said flow meter; and adjust said pump cycle target volume based on a difference between said actual volume and a fixed cycle target volume to produce an adjusted pump cycle target volume, wherein said pump cycle target volume is reset to said adjusted pump cycle target volume for a subsequent discrete pump cycle; and upon calculating the difference between the actual volume and the fixed cycle volume exceeding said pump cycle target volume, setting the adjusted pump cycle volume to zero, wherein the pump is inactive during the subsequent pump cycle.

11. The controller of claim 10, wherein said controller calculates said fixed cycle target volume as a ratio of a total injection volume for an injection period divided by a number of pump cycles for the injection period, wherein the total injection volume and the number of pump cycles are received from the user interface.

12. The controller of claim 11, wherein the pump cycle target volume for an initial pump cycle is set to the fixed cycle target volume.

13. A method for controllably injecting an additive into a hydrocarbon production conduit, comprising:

activating a pump fluidly connecting an additive supply and the hydrocarbon production conduit;

deactivating the pump upon a volume of additive pumped during activation of the pump equaling or exceeding a pump cycle target volume as indicated by a first output signal of a flow meter disposed in a fluid conduit connecting the additive supply and the hydrocarbon production conduit, wherein activating and deactivating the pump defines a pump cycle;

calculating an actual volume of said additive pumped during the pump cycle once fluid flow in said fluid conduit ceases as indicated by a second output signal of said flow meter; and adjusting said pump cycle target volume based on a difference between said actual volume and a fixed cycle target volume to produce an adjusted pump cycle target volume, wherein said pump cycle target volume is reset to said adjusted pump cycle target volume for a subsequent pump cycle; and upon calculating the difference between the actual volume and the fixed cycle volume exceeding said pump cycle target volume, setting the adjusted pump cycle volume to zero, wherein the pump is inactive during the subsequent pump cycle.

14. The method of claim 13, during the subsequent pump cycle further comprising:

activating the pump; and deactivating the pump upon a volume of additive pumped during activation of the pump exceeding the pump cycle target volume, wherein the pump cycle target volume represents the adjusted pump cycle target volume calculated after a previous pump cycle.

15. The method of claim 13, further comprising calculating the fixed cycle target volume as a ratio of a user set number of pump cycles for an additive injection period divided by a user set additive volume for the injection period.

16. The method of claim 15, further comprising receiving user inputs identifying at least one of:

said additive volume for said additive injection period;

said additive injection period; and said number of pump cycles for said additive injection period.

* * * * *